United States Patent [19]

Goser

[11] 4,250,556

[45] Feb. 10, 1981

[54] ELECTRONIC CONTROL SYSTEM FOR ANALOG CIRCUITS

[75] Inventor: Karl Goser, Munich, Fed. Rep. of Germany

[73] Assignee: Siemens Aktiengesellschaft, Berlin & Munich, Fed. Rep. of Germany

[21] Appl. No.: 10,121

[22] Filed: Feb. 6, 1979

[30] Foreign Application Priority Data

Feb. 13, 1978 [DE] Fed. Rep. of Germany ..... 2805940

[51] Int. Cl.[3] ..... G06J 1/00; G06G 7/06

[52] U.S. Cl. ..... 364/600; 340/166 R; 364/861; 364/862

[58] Field of Search ..... 364/600, 602, 800, 807, 364/861, 862; 340/166 R, 147 R

[56] References Cited

U.S. PATENT DOCUMENTS

| | | | |
|---|---|---|---|
| 3,243,582 | 3/1966 | Holst | 364/600 |
| 3,470,362 | 9/1969 | Miller | 364/800 |
| 3,761,689 | 9/1973 | Watanabe et al. | 364/601 |
| 3,795,798 | 3/1974 | Endo et al. | 364/600 |
| 3,800,126 | 3/1974 | Therond et al. | 364/600 |
| 4,057,711 | 11/1977 | Asthana et al. | 364/600 |

OTHER PUBLICATIONS

Philips Technische Rundschau, vol. 31, 1970/1971, No. 4, pp. 97-111.

*Primary Examiner*—Joseph F. Ruggiero
*Attorney, Agent, or Firm*—Hill, Van Santen, Steadman, Chiara & Simpson

[57] ABSTRACT

An electronic control system for analog circuits has controllable analogue circuits which can be combined with one another by way of an electronic switching network. The digital states of the individual crosspoints of the switching network can be programmed by way of a common switching network. In addition, circuitry is provided for adjusting the operating parameters of the individual analogue circuits and the adjustment is accomplished through the values for the operating parameters being determined in a parameter memory according to a program. Finally, a synchronization of the functional sequence of the programs present in two memories is provided.

7 Claims, 3 Drawing Figures

ELECTRONIC CONTROL SYSTEM FOR ANALOG CIRCUITS

BACKGROUND OF THE INVENTION

Field of the Invention

The preset invention relates to an electronic control system for controlling analog circuits, and is more particularly concerned with an electronic control system for combining analogues circuits with one another by way of an electronic switching network.

SUMMARY OF THE INVENTION

The object of the present invention is to provide an electronic control system for analog circuits which is comparable to the microprocessors in digital technology, which, in a manner similar to a microprocessor, is, to great extent, capable of monolithic integration.

The above object is achieved through the provision of a new and improved analog microprocessor which is able, in analogue technology, to transfer to large-integrated standard circuits whose individuality lies in software, i.e. in the program stored in a memory module.

An electronic control system for analog circuits, constructed in accordance with the present invention, features an electronic switching network (or switching matrix array) for combining controllable analogue circuits with one another. The digital states of the individual crosspoints of the switching network can thereby programmed by way of a common switching network memory. Circuitry for adjusting the operating parameters of the individual analogue circuits is provided and the adjustment is accomplished through the values for the operating parameters being determined in accordance with a program in a parameter memory. Synchronization of the functional sequence of the programs present in two memories is provided.

The significant functional units of an analogue microprocessor therefore consist of a switching network, i.e. a matrix of electronic crosspoints with which the different analogue circuits can be interconnected. The switching state of the switching network is determined by way of the content of the switching network memory. The memory content can be varied in a step-wise manner and, therefore, the entire analogue circuit can be adapted to the respective requirements of use. In addition to the memory for the switching network, a parameter memory is provided in which the values for the parameters of the individual analogue circuits are stored.

The adjustment parameters determine, for example, the amplification, the upper frequency limit, the time constants, the adjustment of capacitance diodes, etc.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
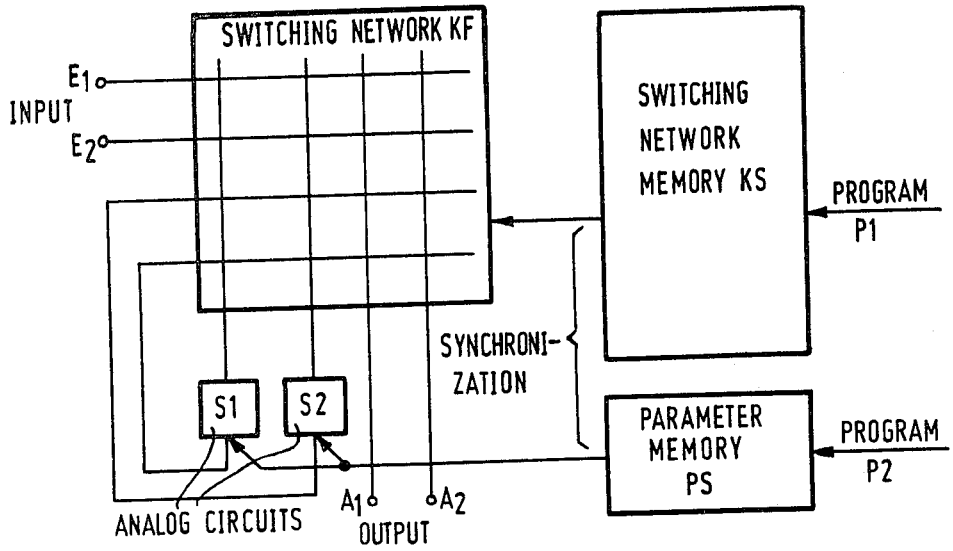
FIG. 1 is a schematic block diagram of an analogue microprocessor constructed in accordance with the present invention.

Referring to FIG. 1, an analogue microprocessor is illustrated which comprises a switching network KF, a switching network memory KS, analogue circuits $S_1$, $S_2$ . . . whose operating states can be determined by way of corresponding parameters, and a parameter memory PS.

By way of the switching network KF, input signals from the input $E_1$, $E_2$ are fed to the corresponding analogue circuits $S_1$, $S_2$ . . . , the different analogue circuits $S_1$, $S_2$ . . . are interconnected, and the output signals are fed to the outputs $A_1$, $A_2$ . . . . Such a switching network can be constructed with known electronic crosspoints, for example, thyristors, in integrated semiconductor technology. It is important here that the coupling between the individual circuit paths be adjusted sufficiently low, for example, at 100 dB.

The circuit state of the switching network KF is determined in a memory, the switching network memory KS. The memory contents are read in from the exterior in the form of a program $P_1$. It is therefore possible, by means of different memory contents, to effect different interconnections of the analogue circuits $S_1$, $S_2$ . . . .

A second memory, the parameter memory PS, serves the purpose of storing the circuit parameters for the analogue circuits $S_1$, $S_2$ . . . , which parameters are to be utilized in the course of operation of the system. These values are, in turn, externally input into the memory PS in the form of a program $P_2$. Such parameters can, for example, be the amplification, the upper and the lower frequency limits, time constants, etc. The memory PS, for example, will control the same by way of programmable resistances or capacitances at the analogue circuits $S_1$, $S_2$ . . . .

A synchronization ensures that the two memories KS and PS forward the data stored therein in the correct sequence to the switching network KF, and, subsequent to its adjustment, or readjustment, respectively, to the intended analogue circuits, respectively.

In the case of the analogue microprocessor illustrated in FIG. 1, the interconnections of the analogue circuits $S_1$, $S_2$ . . . , as well as the adjustment of the parameters of the analogue circuits, is programmable. In case it is intended that the controlling signals be able to pass through the analogue circuits $S_1$, $S_2$ repeatedly, it will be advantageously ensured that the connections between the individual operations are newly programmed, and that the signal, in the meantime, is intermediately stored in a delay line. This is the case with the system of an analogue microprocessor illustrated in FIG. 2.

Figure 2:
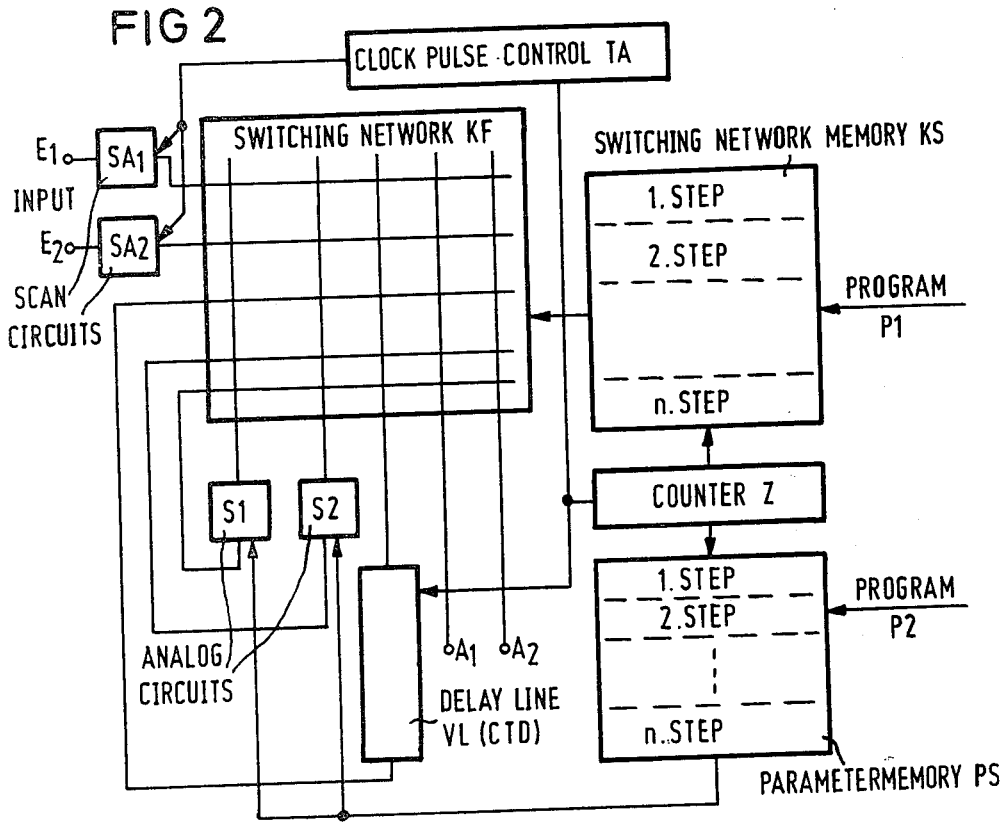
FIG. 2 is a schematic block diagram of another embodiment of the invention illustrated in FIG. 1.

The analogue microprocessor illustrated in FIG. 2 differs from the apparatus illustrated in FIG. 1 through the utilization of a delay line, particularly in the form of a CTD arrangement which, for example, can be represented in bipolar fashion in the form of a BBD system (bucket brigade device) or in MOS technology (CCD systems).

It is hereby intended that, in a first clock pulse, signals from the inputs $E_1$, $E_2$ . . . pass through the analogue circuits $S_1$, $S_2$ . . . , but are not immediately fed to the outputs $A_1$, $A_2$ . . . , but, on the contrary, remain for the time being in the delay line VL. During this time, the analogue circuits $S_1$, $S_2$ . . . can be newly programmed by transferring to the second program step. The analogue signals in the delay line, or delay lines, respectively, are further processed in the newly programmed analogue circuits. These steps can be repeated so many times until the analogue signal has achieved the degree of processing which is demanded in each case. In the case of the analogue microprocessor illustrated in FIG. 2, as in the case of the arrangement illustrated in FIG. 1, a clock pulse control is to be provided which, here, additionally provides the clock pulses for the delay line, or delay lines, respectively, and, moreover, as also in the case of an arrangement according to FIG. 1, provides the clock pulses for the change in the switching network memory KF and in the parameter memory PS to the storage fields (or networks) of the individual steps and for the scan circuit $\overline{SA}_1$, $\overline{SA}_2$ . . . at the input. The scan circuits at the inputs $E_1$, $E_2$ . . . have the task of scanning the supplied analogue signals and bringing the same into a state which renders them suitable for transport in a BBD system or CCD system, respectively, as the delay line, said system being manufactured in monolithic semiconductor technology. These systems are likewise controlled by the central clock pulse generator TA. The CTD delay lines VL are, in an exemplary case, connected between two different lines each of the switching network KF, for example, a line-parallel line and a column-parallel line.

Figure 3:
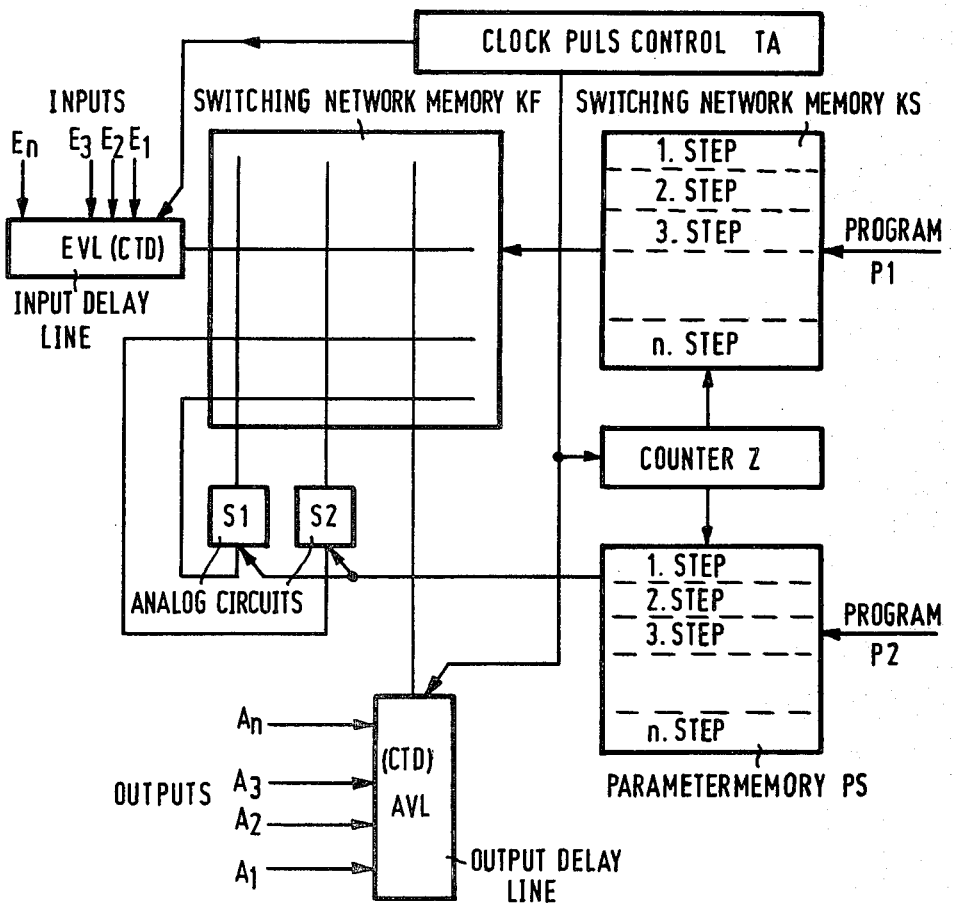
FIG. 3 is a schematic block diagram of another embodiment of the invention illustrated in FIG. 1.

The analogue microprocessor can additionally be expanded by one step. This is illustrated in FIG. 3. At the input to the switching network KF, a delay line EVL is provided which manifests the parallel inputs $E_1$, $E_2$ . . . $E_n$. The scanning value of a plurality of different input signals can thereby be received successively.

The method of operation of the circuit is as follows.

The scan value $E_1$ of the first analogue signal is input first. This value is processed corresponding to the data in the analogue circuits $S_1$, $S_2$ . . . written in the first field of the memories KS and PS, and is then fed to a delay line AVL at the output. Subsequently, the scan value $E_2$ of the second analogue signal is input. In the meantime, the analogue circuits $S_1$, $S_2$ have been programmed corresponding to the data written in the second field of the memories. Subsequent to the processing, the signal is again fed to the delay line at the output. This operation is repeated with the third, the fourth, and finally with the nth analogue signal, whereby between the scan values, respectively, the analogue circuits are programmed corresponding to the third, fourth, etc., and finally nth storage field of the two memories. It is therefore possible to process different analogue signals with the same circuit. At the output, the processed signals are fed out by way of delay line taps $A_1$, $A_2$ . . . $A_n$.

In the realization of the arrangements in integrated semiconductor technology illustrated in FIGS. 2 and 3, the construction of the delay lines is recommended in one of the two following forms:

(a) In the case of realization in bipolar IC-technology, bucket brigade circuits (BBDs) in oxide-insulation technology are particularly suited for the delay lines. They are described, for example, in "Philips Technische Rundschau" 31 (1970/71), No. 4, pp. 97--111.

(b) In the realization in MOS-technology, so-called charge coupled circuits (CCDs) are particularly favorable for the delay lines, and so-called floating gate amplifiers are particularly favorable for the amplifier circuits.

From the literature, CCD systems are presently known which are characterized by a storage time of 160 s at 50% charge loss and by a uniformity of less than ± 1% from element-to-element, so that they can be readily utilized for analogue memories.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electronic control system for analog circuits, comprising:
- a switching network including switching crosspoints;
- a plurality of controllable analog circuits connected to said switching network;
- a switching network memory storing a switching program and operable to control said crosspoints;
- parameter means connected to and operable to adjust the operating parameters of the individual analog circuits, including a parameter memory storing a parameter program;
- synchronization means connected to said memories for controlling synchronous operation thereof;
- an input delay line connected to said network;
- an output delay line connected to said network;
- a plurality of inputs connected to said input delay line; and
- a plurality of outputs connected to said output delay line;
- each of said delay lines connected to a respective line of said network, and
- each of said analog circuits connected to a respective line of said network.

2. An electronic control system for analog circuits, comprising:
- a switching network including switching crosspoints;
- a plurality of controllable analog circuits connected to said switching network;
- a switching network memory storing a switching program and operable to control said crosspoints;
- parameter means connected to and operable to adjust the operating parameters of the individual analog circuits, including a parameter memory storing a parameter program;
- synchronization means connected to said memories for controlling synchronous operation thereof;
- at least one delay line connected to at least one line of said switching network; and
- a clock connected to and controlling said delay line, said synchronization means including a counter connected to sequence said memories and connected to and operated by said clock.

3. The system of claim 2, wherein said delay line is connected between a column and a line of said network.

4. The system of claim 2, comprising:
- at least one scan circuit connected to said network and including at least one input for receiving an input signal.

5. An electronic control system for analog circuits, comprising:
- a switching network including switching crosspoints;
- a plurality of controllable analog circuits connected to said switching network;
- a switching network memory storing a switching program and operable to control said crosspoints;

parameter means connected to and operable to adjust the operating parameters of the individual analog circuits, including a parameter memory storing a parameter program;

synchronization means connected to said memories for controlling synchronous operation thereof;

an input delay line connected to said network;

an output delay line connected to said network;

a plurality of inputs connected to said input delay line;

each of said inputs including a scan circuit including an input for receiving an input signal, said scan circuits connected to and operated by said synchronization means; and a plurality of outputs connected to said output delay line;

each of said delay lines connected to a respective line of said network, and each of said analog circuits connected to a respective line of said network.

6. The system of claim 5, wherein:

each of said delay lines is an integrated circuit delay line.

7. An electronic control system for analog circuits, comprising:

a switching network including switching crosspoints;

a plurality of controllable analog circuits connected to said switching network;

a switching network memory storing a switching program and operable to control said crosspoints;

parameter means connected to and operable to adjust the operating parameters of the individual analog circuits, including a parameter memory storing a parameter program;

synchronization means connected to said memories for controlling synchronous operation thereof; and at least one delay line connected to at least one line of said switching network and connected to and controlled by said synchronization means.

* * * * *